US008960332B2

(12) United States Patent
Ugwuocha et al.

(10) Patent No.: US 8,960,332 B2
(45) Date of Patent: Feb. 24, 2015

(54) EARTH REMOVAL MEMBER WITH FEATURES FOR FACILITATING DRILL-THROUGH

(75) Inventors: Sharp Ugwuocha, Aberdeen (GB); Steven Rae, Aberdeen (GB)

(73) Assignee: Weatherford/Lamb, Inc., Houston, TX (US)

( * ) Notice: Subject to any disclaimer, the term of this patent is extended or adjusted under 35 U.S.C. 154(b) by 412 days.

(21) Appl. No.: 13/333,749

(22) Filed: Dec. 21, 2011

(65) Prior Publication Data

US 2012/0160562 A1 Jun. 28, 2012

Related U.S. Application Data

(60) Provisional application No. 61/459,969, filed on Dec. 22, 2010.

(51) Int. Cl.

| | |
|---|---|
| ***E21B 7/00*** | (2006.01) |
| ***E21B 10/633*** | (2006.01) |
| ***E21B 10/42*** | (2006.01) |
| ***E21B 10/627*** | (2006.01) |

(52) U.S. Cl.
CPC ..... *E21B 10/42* (2013.01); *E21B 10/627* (2013.01)
USPC ..... 175/171; 175/413

(58) Field of Classification Search
CPC ..... E21B 10/42; E21B 10/602
USPC ..... 175/22, 57, 171, 413
See application file for complete search history.

(56) References Cited

U.S. PATENT DOCUMENTS

| | | | | | |
|---|---|---|---|---|---|
| 1,388,490 | A | | 8/1921 | Suman | |
| 1,586,415 | A | * | 5/1926 | Duda | 175/245 |
| 1,644,142 | A | * | 10/1927 | Metzger et al. | 175/413 |
| 1,950,101 | A | * | 3/1934 | Dixon | 175/404 |
| 2,003,144 | A | * | 5/1935 | Graham, Jr. | 175/399 |
| 2,252,745 | A | * | 8/1941 | Williams | 175/413 |
| 2,290,595 | A | * | 7/1942 | Kinnear | 175/379 |
| 2,408,892 | A | * | 10/1946 | Stokes | 175/393 |
| 2,693,938 | A | * | 11/1954 | Roberts | 175/397 |
| 2,738,011 | A | | 3/1956 | Mabry | |
| 2,803,435 | A | * | 8/1957 | Kammerer, Jr. | 175/413 |
| 2,978,049 | A | * | 4/1961 | Skidmore et al. | 175/391 |
| 3,621,910 | A | | 11/1971 | Sanford et al. | |
| 3,645,331 | A | | 2/1972 | Maurer et al. | |

(Continued)

FOREIGN PATENT DOCUMENTS

| | | | |
|---|---|---|---|
| CN | 200978623 | | 11/2007 |
| GB | 2294715 | A | 5/1996 |
| WO | 2004/076804 | A1 | 9/2004 |

OTHER PUBLICATIONS

Weatherford International Ltd.—"DrillShoe III" brochure, date unknown, 4 pages.

(Continued)

*Primary Examiner* — Kenneth L Thompson
(74) *Attorney, Agent, or Firm* — Patterson & Sheridan LLP

(57) ABSTRACT

An earth removal member with features for facilitating drill-through is provided for drilling with casing or liner applications. In one embodiment, the casing bit includes a tubular body; a nose attached to one end of the tubular body, wherein the nose includes a blade support and comprises a drillable material; a blade attached to the blade support using mating profiles; cutters disposed along the blade; and a nozzle disposed in the nose.

27 Claims, 16 Drawing Sheets

(56) References Cited

U.S. PATENT DOCUMENTS

| | | | | |
|---|---|---|---|---|
| 3,688,853 | A | 9/1972 | Maurer et al. | |
| 3,760,894 | A * | 9/1973 | Pitifer | 175/413 |
| 4,273,190 | A | 6/1981 | Baker et al. | |
| 4,397,355 | A | 8/1983 | McLamore | |
| 4,466,498 | A * | 8/1984 | Bardwell | 175/426 |
| 4,739,845 | A | 4/1988 | Dennis | |
| 4,838,366 | A * | 6/1989 | Jones | 175/426 |
| 5,195,591 | A | 3/1993 | Blount et al. | |
| 5,271,472 | A | 12/1993 | Leturno | |
| 5,647,437 | A | 7/1997 | Braddick et al. | |
| 5,950,742 | A | 9/1999 | Caraway | |
| 5,957,225 | A | 9/1999 | Sinor | |
| 6,062,326 | A | 5/2000 | Strong et al. | |
| 6,106,200 | A | 8/2000 | Mocivnik et al. | |
| 6,142,248 | A | 11/2000 | Thigpen et al. | |
| 6,263,987 | B1 | 7/2001 | Vail, III | |
| 6,311,793 | B1 | 11/2001 | Larsen et al. | |
| 6,390,211 | B1 | 5/2002 | Tibbitts | |
| 6,408,957 | B1 | 6/2002 | Slaughter, Jr. et al. | |
| 6,443,247 | B1 * | 9/2002 | Wardley | 175/402 |
| 6,454,007 | B1 | 9/2002 | Bailey | |
| 6,585,063 | B2 | 7/2003 | Larsen | |
| 6,983,811 | B2 | 1/2006 | Wardley | |
| 7,077,212 | B2 | 7/2006 | Roesner et al. | |
| 7,096,982 | B2 | 8/2006 | McKay et al. | |
| 7,216,727 | B2 | 5/2007 | Wardley | |
| 7,311,148 | B2 | 12/2007 | Giroux et al. | |
| 7,395,882 | B2 | 7/2008 | Oldham et al. | |
| 8,074,749 | B2 | 12/2011 | Twardowski et al. | |
| 8,443,915 | B2 * | 5/2013 | Storm et al. | 175/40 |
| 2003/0024742 | A1 | 2/2003 | Swietlik et al. | |
| 2003/0164250 | A1 | 9/2003 | Wardley | |
| 2004/0011534 | A1 | 1/2004 | Simonds et al. | |
| 2004/0020635 | A1 | 2/2004 | Connell et al. | |
| 2004/0118614 | A1 | 6/2004 | Galloway et al. | |
| 2004/0226751 | A1 * | 11/2004 | McKay et al. | 175/57 |
| 2004/0245020 | A1 | 12/2004 | Giroux et al. | |
| 2005/0183892 | A1 | 8/2005 | Oldham et al. | |
| 2006/0185855 | A1 | 8/2006 | Jordan et al. | |
| 2006/0278442 | A1 | 12/2006 | Kristensen | |
| 2007/0251732 | A1 * | 11/2007 | Mirchandani et al. | 175/393 |
| 2009/0120693 | A1 | 5/2009 | McClain et al. | |
| 2010/0307837 | A1 | 12/2010 | King et al. | |

OTHER PUBLICATIONS

PCT International Search Report and Written Opinion; International Application No. PCT/US2011/066607; Mailed Mar. 1, 2013.

Canadian Office Action for Canadian Patent Applicaton No. 2,820,954, dated Jul. 9, 2014.

* cited by examiner

EARTH REMOVAL MEMBER WITH FEATURES FOR FACILITATING DRILL-THROUGH

CROSS-REFERENCE TO RELATED APPLICATIONS

This application claims benefit of U.S. Provisional Patent Application Ser. No. 61/459,969, filed Dec. 22, 2010, which application is incorporated herein by reference in its entirety.

BACKGROUND OF THE INVENTION

1. Field of the Invention

Embodiments of the present invention generally relate to an earth removal member with features for facilitating subsequent drill-through.

2. Description of the Related Art

The drilling of wellbores for oil and gas production conventionally employs strings of drill pipe to which, at one end, is secured a drill bit. After a selected portion of the wellbore has been drilled, the wellbore is usually cased with a string of casing or lined with a string of liner. Drilling and casing/lining according to the conventional process typically requires sequentially drilling the wellbore using drill string with a drill bit attached thereto, removing the drill string and drill bit from the wellbore, and disposing casing/lining into the wellbore. Further, often after a section of the borehole cased/lined, which is usually cemented into place, additional drilling beyond the end of the casing/liner may be desired.

Unfortunately, sequential drilling and casing may be time consuming because, as may be appreciated, at the considerable depths reached during oil and gas production, the time required to retrieve the drill string may be considerable. Thus, such operations may be costly as well due to the high cost of rig time. Moreover, control of the well may be difficult during the period of time that the drill pipe is being removed and the casing/lining is being disposed into the borehole.

Some approaches have been developed to address the difficulties associated with conventional drilling and casing/lining operations. Of initial interest is an apparatus which is known as a reaming casing shoe that has been used in conventional drilling operations. Reaming casing shoes have become available relatively recently and are devices that are able to drill through modest obstructions within a borehole that has been previously drilled.

As a further extension of the reaming casing shoe concept, in order to address the problems with sequential drilling and casing, drilling with casing/liner is gaining popularity as a method for drilling a wellbore, wherein the casing/liner is used as the drill string and, after drilling, the casing/liner remains downhole to line the wellbore. Drilling with casing/liner employs a drill bit attached to the casing/liner string, so that the drill bit functions not only to drill the earth formation, but also to guide the casing/liner into the wellbore. This may be advantageous as the casing/liner is disposed into the wellbore as it is formed by the drill bit, and therefore eliminates the necessity of retrieving the drill string and drill bit after reaching a target depth where cementing is desired.

While this procedure greatly increases the efficiency of the drilling procedure, a further problem is encountered when the casing/liner is cemented upon reaching the desired depth. While one advantage of drilling with casing is that the drill bit does not have to be retrieved from the wellbore, further drilling may be required. Thus, further drilling must pass through the drill bit attached to the end of the casing/liner.

However, drilling through the casing/liner drill bit may be difficult as drill bits are required to remove rock from formations and accordingly often include very drilling resistant, robust structures typically manufactured from hard or superhard materials. Attempting to drill through a drill bit affixed to the end of a casing/liner may result in damage to the subsequent drill bit and bottom-hole assembly deployed or possibly the casing/liner itself. It may be possible to drill through a drill bit or a casing with special tools known as mills, but these tools are unable to penetrate rock formations effectively and the mill would have to be retrieved or "tripped" from the wellbore and replaced with a drill bit. In this case, the time and expense saved by drilling with casing would be mitigated or even lost.

SUMMARY OF THE INVENTION

Embodiments of the present invention generally relate to an earth removal member with features for facilitating subsequent drill-through. In one embodiment, the earth removal member includes a tubular body; a nose attached to one end of the tubular body, wherein the nose includes a blade support and comprises a drillable material; a blade attached to the blade support using mating profiles; cutters disposed along the blade; and a nozzle disposed in the nose.

In another embodiment, the earth removal member includes a pin disposed in the blade support and the blade. In yet another embodiment, at least two blades are connected to each other. In still yet another embodiment, at least a face portion of the nose has an aluminum cross-section.

In another embodiment, a method of removing or partially removing an earth removal member includes providing the earth removal member with a tubular body; a nose attached to one end of the tubular body, wherein the nose includes a blade support and comprises a drillable material; a blade attached to the nose using mating profiles; and cutters disposed along the blade. The method also includes positioning a drill bit in the tubular body; rotating the drill bit against an interior surface of the nose; removing a portion of the nose while the blade is substantially attached to the nose; and rotating the drill bit against the blade, thereby breaking the blade into smaller pieces. In another embodiment, the nose may remain axially fixed to the tubular body during drill out.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIG. 8 shows an earth removal member after it has been drilled through.

DETAILED DESCRIPTION

Figure 1:
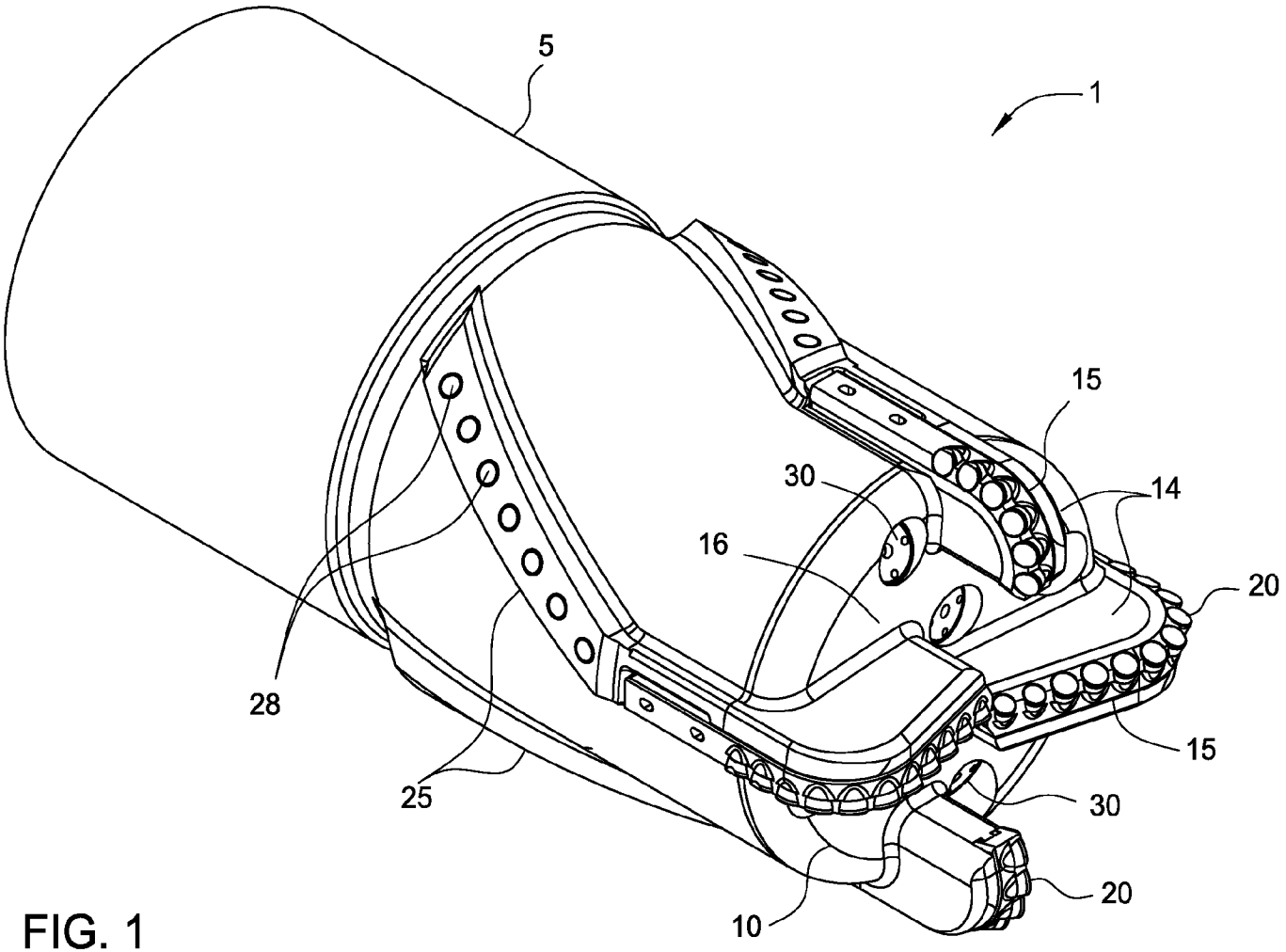
FIG. 1 is a perspective view of an embodiment of an earth removal member.
Figure 2:
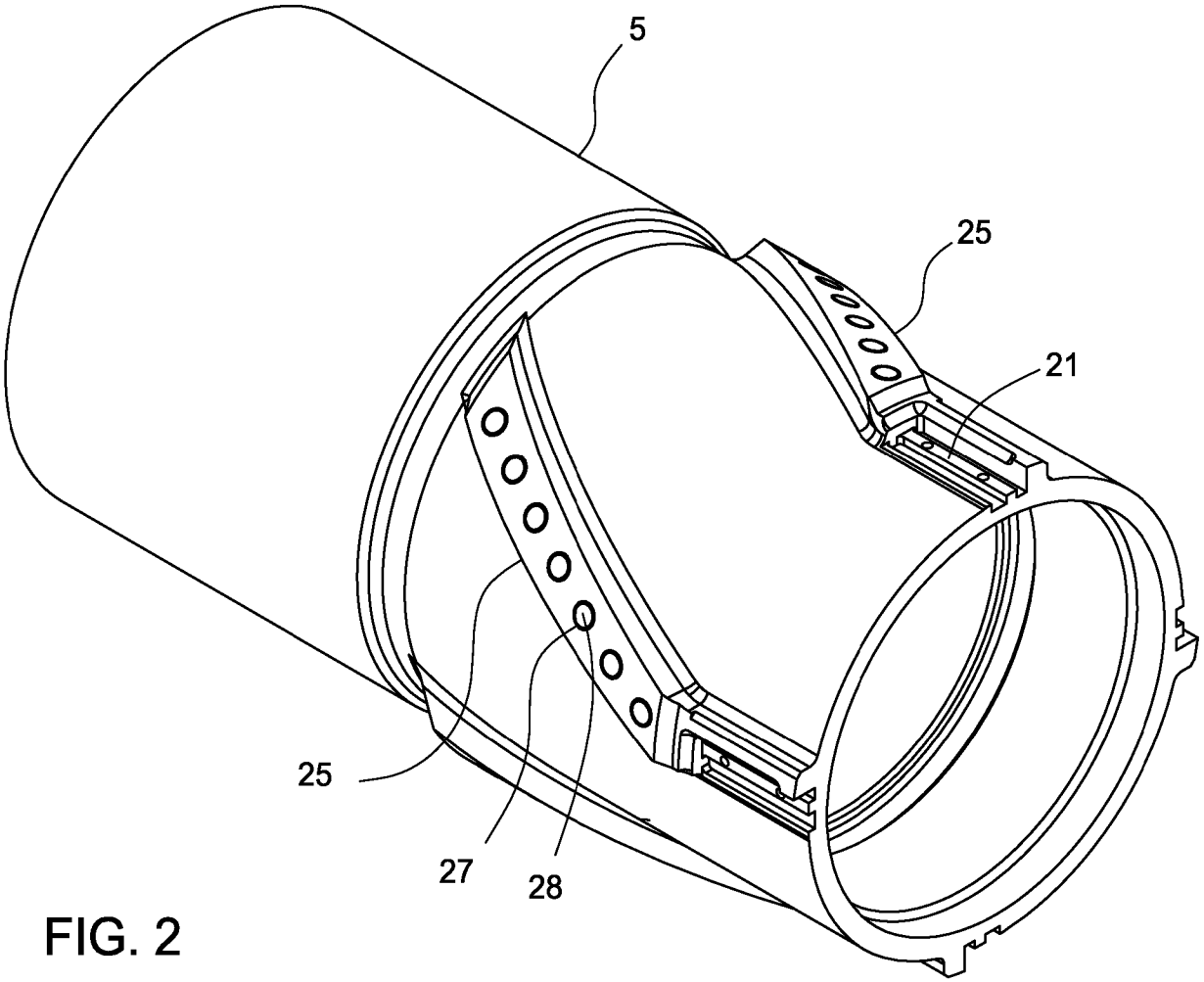
FIG. 2 shows a perspective view of the body 5 of the earth removal member of FIG. 1.
Figure 3:
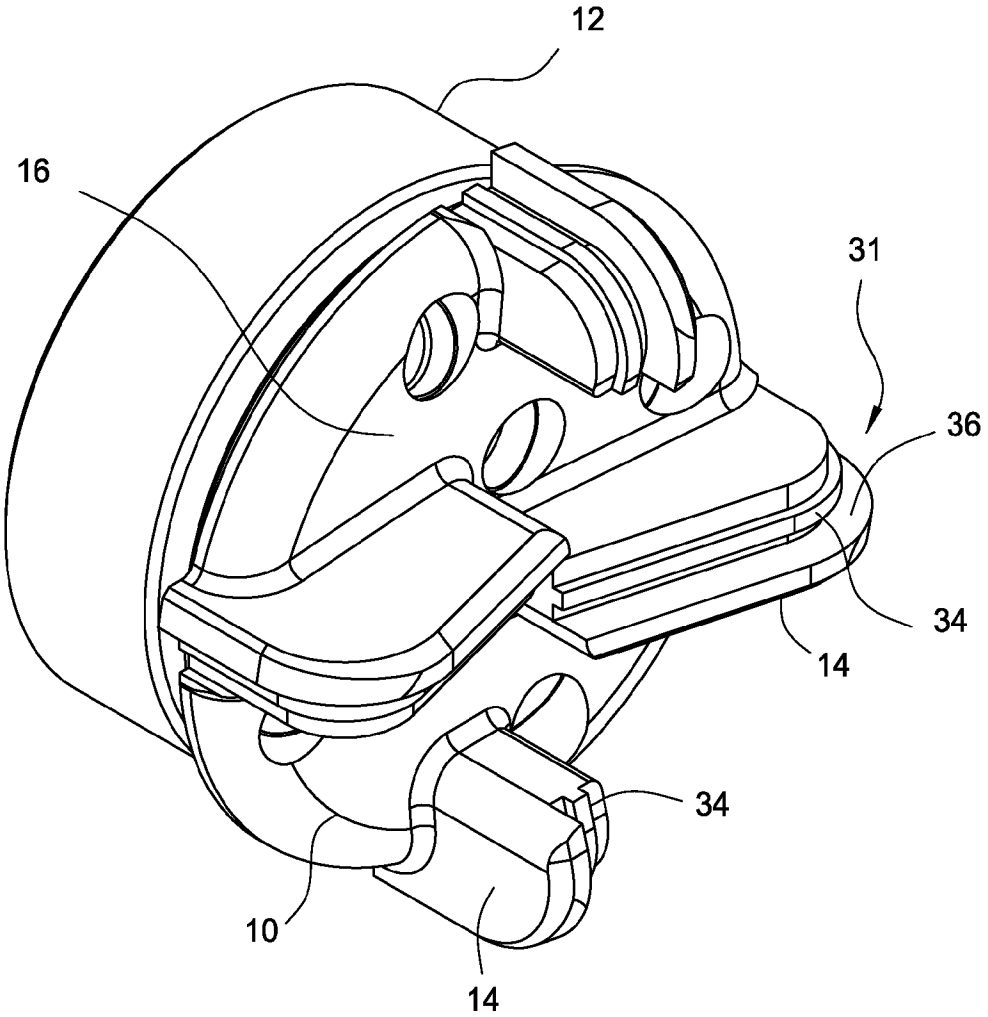
FIG. 3 shows a perspective view of the nose 10 of the earth removal member of FIG. 1.
Figure 4:
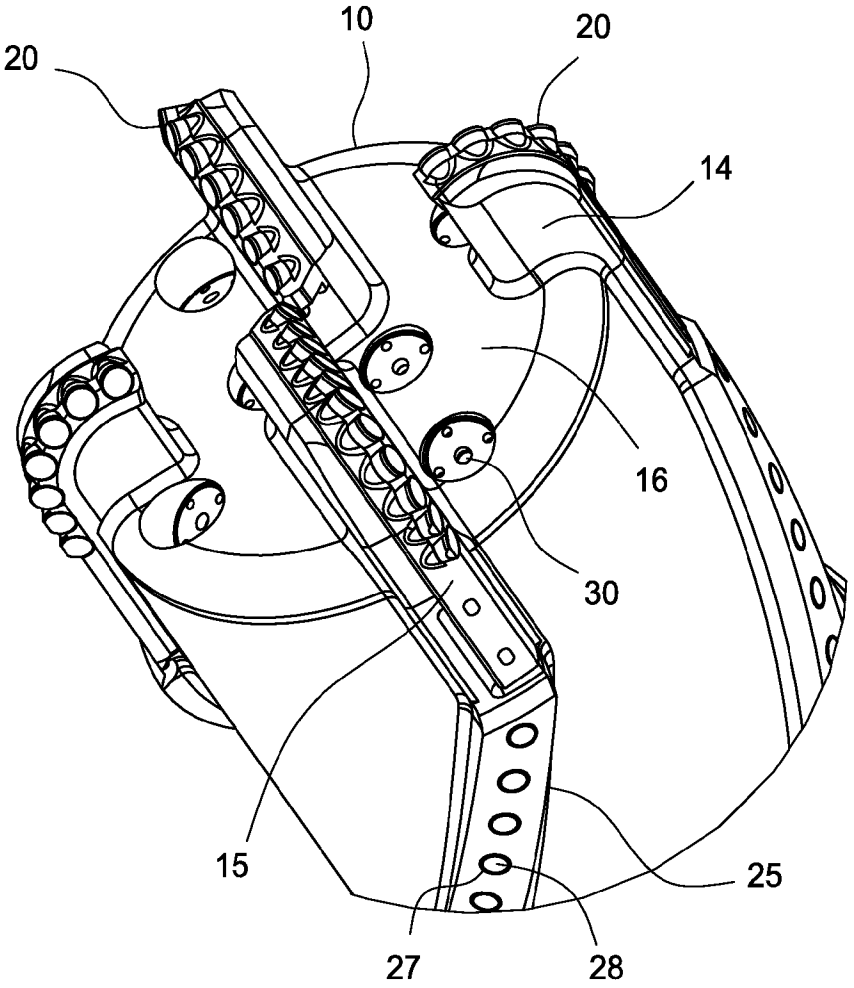
FIG. 4 shows another embodiment of the earth removal member.

FIG. 1 is a perspective view of an earth removal member, such as a casing bit 1, according to one embodiment of the present invention. Alternatively, the earth removal member may be a drill bit, reamer shoe, a pilot bit, a core bit, or a hammer bit. The casing bit 1 may include a body 5, a nose 10, one or more blades 15, one or more cutters 20, one or more stabilizers 25, and one or more nozzles 30. FIG. 2 shows a perspective view of the body 5. FIG. 3 shows a perspective view of the nose 10. FIG. 4 shows another perspective view of the casing bit 1 of FIG. 1.

Referring to FIG. 2, the body 5 may be tubular shaped having one end adapted for connection with the nose 10, for example, using a threaded connection, adhesive, or weld. The other end may have threads for connection with a bottom of a casing or liner string (not shown) or a casing adapter having a pin or box for connection with the casing or liner bottom. In another embodiment, the nose 10 may be attached to the body 5 using a weld or locking members such pins or screws. Stabilizers 25 may be formed on the outer surface of the body 5. The stabilizers 25 may optionally include recesses 27 for receiving an insert. The outer surface of the body 5 also includes profiles 21 for attachment with the blades 15. A port 57 having a shearable member such as rupture disc may be provided on the body 5 as illustrated in FIG. 7A. The body 5 is made from any suitable material that provides suitable mechanical properties to substantially complement those of the casing to liner to which the body is attached, for example, steel.

The stabilizers 25 may extend longitudinally and/or helically along the body 5. The stabilizers 25 may be formed integrally or attached to the body 5. The stabilizers 25 may be made from the same material as the body 5. The stabilizers 25 may be aligned with the blades 15. An outer surface of the stabilizers 25 may extend outward past the gage portion of each blade 15. Inserts 28, such as buttons (shown in FIGS. 1 and 4), may be disposed along an outer surface of each of the stabilizers 25. The inserts 28 may be made from a wear-resistant material, such as a ceramic or cermet (i.e., tungsten carbide), diamond (i.e., PDC), or any suitable wear-resistant material. The inserts 28 may be brazed, welded, or pressed into recesses 27 formed in the outer surface of the stabilizers 25 so that the buttons are flush with or extend outward past the stabilizer outer surface. In one embodiment, the wear resistant carbide buttons could also be welded-on hardfacing material.

As shown in FIG. 3, the nose 10 may include a threaded portion 12 for attachment to the body 5. The face 16 of the nose 10 above the threaded portion 12 may have a larger diameter than the threaded portion 12. A plurality of blade supports 14 may be formed on the face 16 of the nose 10. The blade supports 14 are configured to receive a respective blade 15 thereon. In one embodiment, the blade supports 14 are raised portions on the face 16. The blade supports 14 may be formed integrally such as by casting, machining, or attached by weld to the nose 10. The blade supports 14 may each extend radially or helically to a center of the face 16. For example, the blade supports 14 may extend radially or helically to a substantial distance toward the face center, such as greater than or equal to one-third or one-half the radius of the nose 10. A height of the blade supports 14 may decrease as the blade supports extend from the side toward the center of the face 16.

The nose 10, including the blade supports 14, may be made from a drillable material, for example, metal or alloy such as aluminum, or a composite such as cermet. The face 16 should have sufficient thickness to counter weight on bit deflections during the drilling operation, as shown in FIG. 7A. For example, the face 16 may have a thickness of at least one inch, preferably between 1 and 2 inches. In one embodiment, at least 50% by weight of the nose 10 is made of aluminum; preferably, at least 75% by weight is made of aluminum; and more preferably, at least 90% by weight of the nose 10 is made of aluminum. Other suitable drillable material include any material which has sufficient structural strength to support the loads applied to the blades during use of the earth removal member, but also which has properties suitable for subsequent removal by a standard drill bit. In one embodiment, the nose 10 may be made of a composite such as glass/epoxy or a plastic material. In an exemplary embodiment, the face portion 16 of the nose 10 has an aluminum cross-section. The inner surface of the nose 10 may be profiled with a curvature or flat. The drillable material allows the nose 10 to be drilled through and the body 5 to remain after drill/mill-through. The face 16 may be drilled through after cementing the casing and the casing bit into the wellbore.

Referring back to FIGS. 3 and 4, the blade supports 14 may include a profile 31 for mating with a blade 15. In one embodiment, the profile 31 is formed on an upper surface of the blade support 14. The profile 31 includes a floor surface 34 having a protrusion and a side wall surface 36. In another embodiment, the protrusion may be formed on the side wall surface 36 or both surfaces 34, 36.

FIGS. 5 and 5A-D are different perspective views of an exemplary blade 15. The blade 15 may have a mating profile 43 for attachment with the profile 31 on the blade support 14. As shown, the profile 43 extends along the entire length of the blade 15, which includes a cutter portion 41 and a body portion 42. As shown, the blade profile 43 includes a back wall 46 for mating with the side wall surface 36. Also, the blade profile 43 includes a lower surface 44 having a groove for mating with the protrusion of the blade support 14. It is contemplated that the protrusion may be formed on the blade 15, while the groove is formed on the blade support 14. In one embodiment, the blade 15 is shaped to conform to the overall shape of the blade supports 14. In this respect, the blade 15 may remain in position relying only on its overall shape and the mating profiles 31, 43. Alternatively, an adhesive may be used to attach the blade 15 to the blade support 14. The body portion 42 may include holes 48 for receiving a pin or screw to attach the blade 15 to the body 5.

Figure 5B:
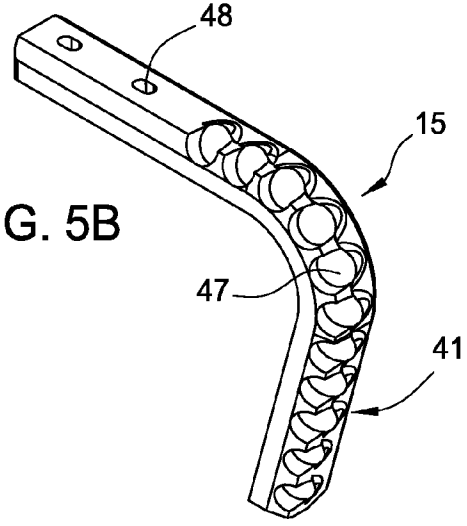
FIGS. 5 and 5A-D are different perspective views of an exemplary blade of the earth removal member of FIG. 1.
Figure 5A:
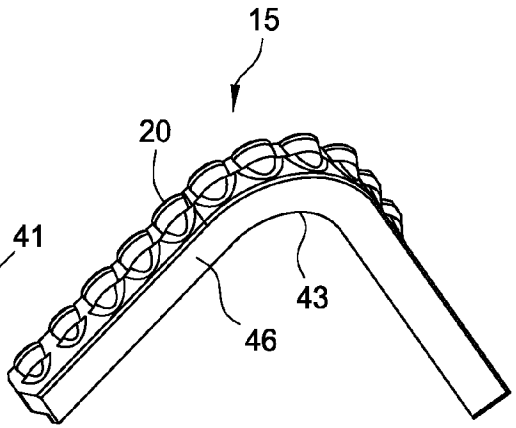
Figure 5:
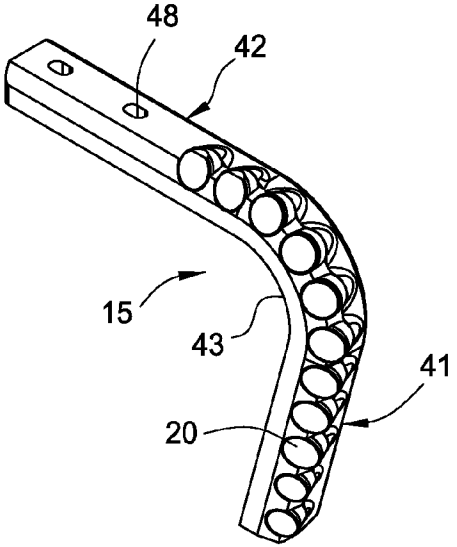
Figure 5C:
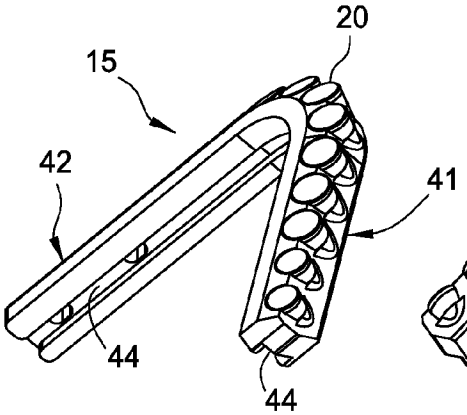
Figure 5D:
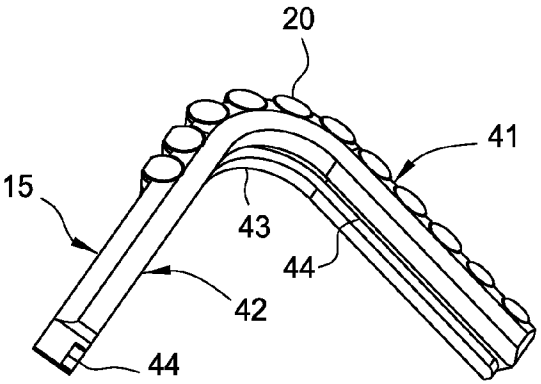

The cutter portion 41 includes a plurality of recesses 47 (shown in FIG. 5B) for receiving a plurality of cutters 20, as shown in FIGS. 5 and 5D. The cutters 20 may be bonded into respective recesses 47 formed along each blade 15. The cutters 20 may be made from a super-hard material, such as polycrystalline diamond compact (PDC), natural diamond, or cubic boron nitride. The PDC may be conventional, cellular, or thermally stable (TSP). The cutters 20 may be bonded into the recesses 47, such as by brazing, welding, soldering, press fitting, using an adhesive, and combinations thereof. The cutters 20 may be disposed along each blade 15 and be located in both gage and face portions of each blade. Alternatively, the blades 15 may be omitted and the cutters 20 may be disposed directly in the blade support 14 and/or the nose 10, such as in the face 16 and/or the side. In another embodiment, the blades include a wear resistant coating. For example, the blades may be sprayed with a coating of HVOF ("high velocity oxygen fuel") to increase the erosion resistance of the blades.

Figure 6A:
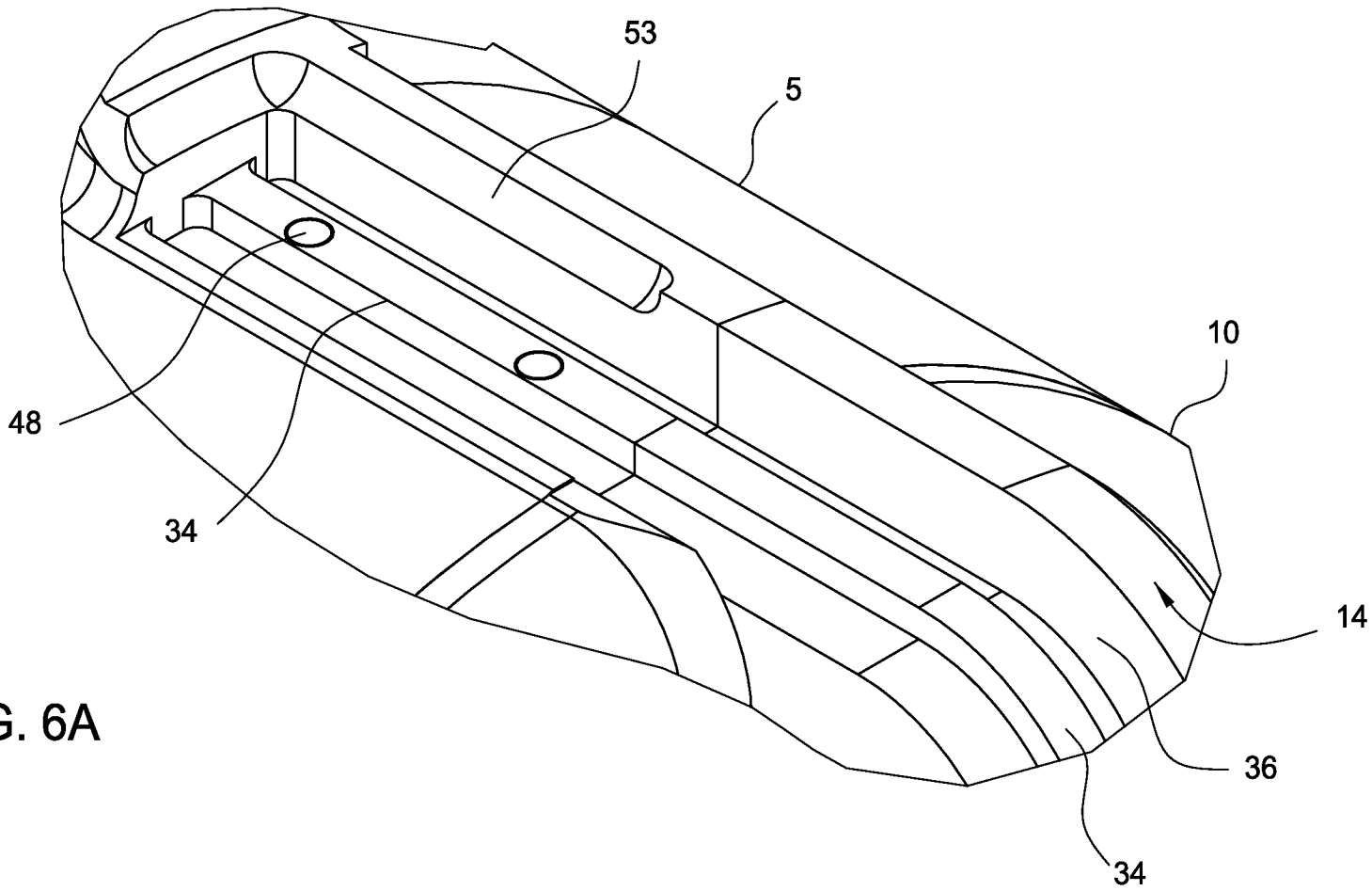
FIGS. 6A-B are perspective views of an exemplary body and a blade attached to the body.
Figure 6B:
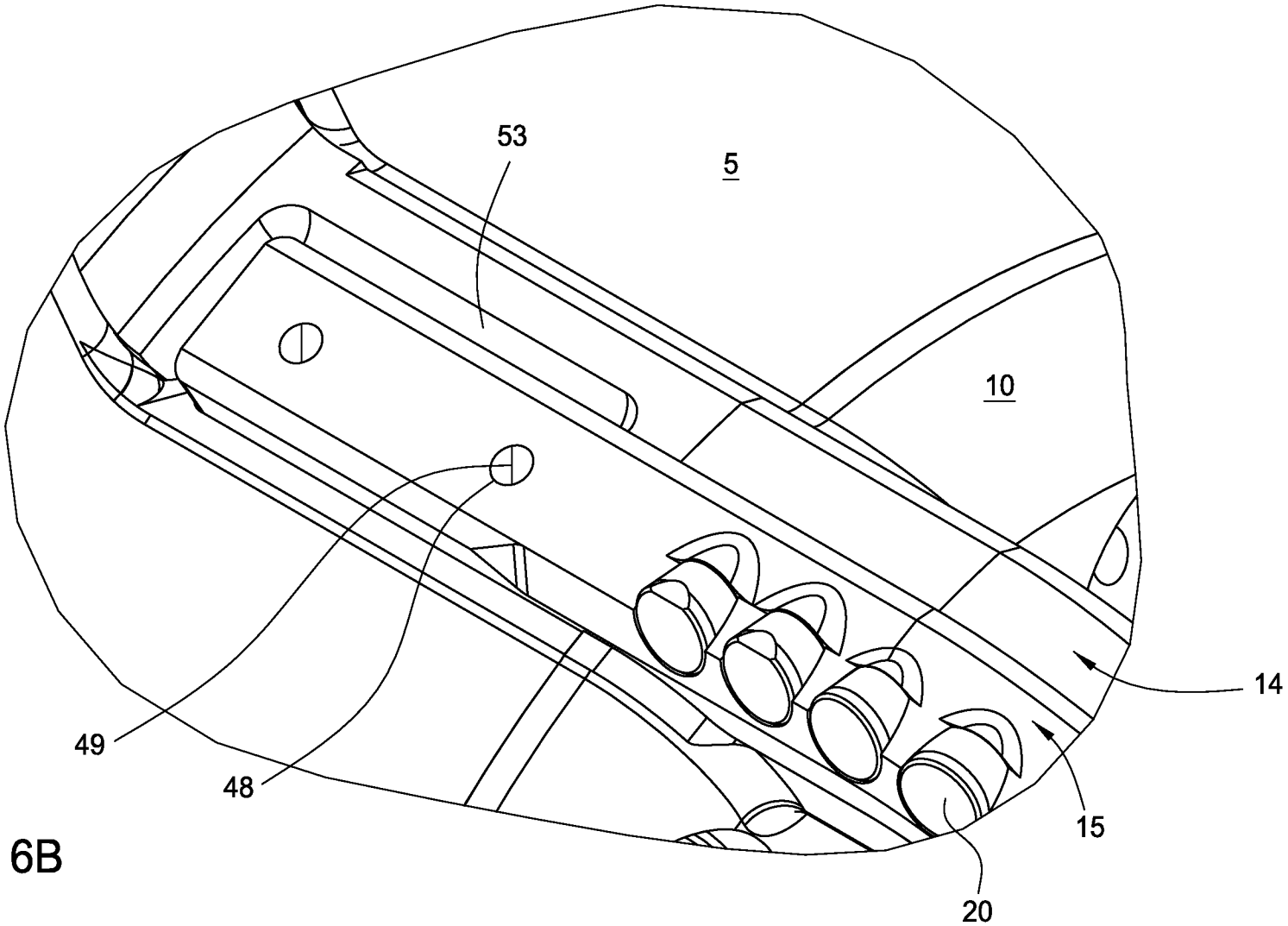

FIGS. 6A-B are enlarged partial views of the body 5 before (6A) and after (6B) attachment of the blades 15. The blades 15 may be made of steel and attached to the body 5 by welding. An exemplary steel material for the blades 15 is low yield steel. In another example, the blade is made of cast iron. Referring now to FIGS. 6A-B, the blade 15 is first secured to the body 5 by inserting a cap screw 49 through the blade 15 and into a hole 48 in the body 5. Then, the blade is welded to the body 5. The profile on the body 5 for receiving the blade 15 may have pockets 53 for accommodating the weld material connecting the blade 15 to the body 5. After welding, the cap screw 49 is optionally removed. In another embodiment, the blades may also be attached by wedging into a groove on the side of the body. In this configuration, the blades would be wedged tighter to the body upon application of weight on bit. Alternatively, the blades 15 may be bonded or otherwise attached to the blade supports 14, such as by brazing, soldering, or using an adhesive. In this alternative, the blades may be made from a drillable material, such as a nonferrous metal or alloy (i.e., copper, brass, bronze, aluminum, zinc, tin, or alloys thereof), a polymer, or composite.

Figure 7B:
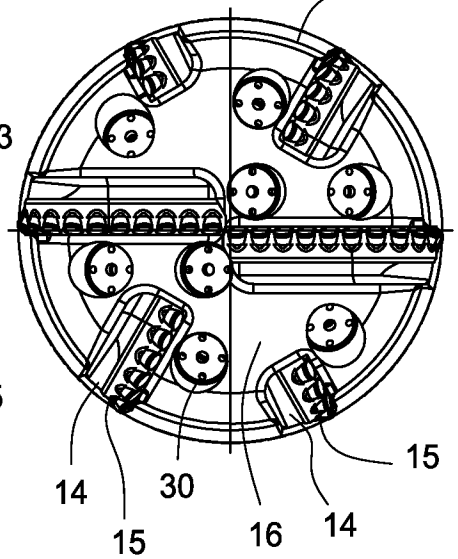
FIG. 7B is an end view of the earth removal member.
Figure 7A:
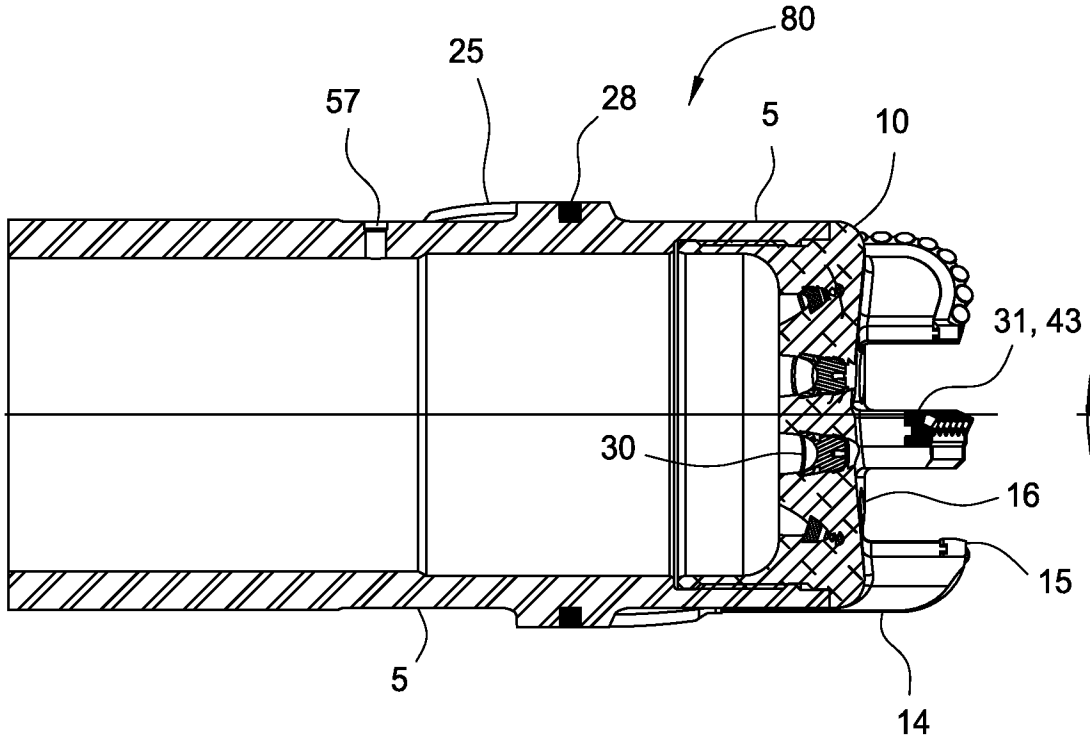
FIG. 7A is a cross-sectional view of another embodiment of an exemplary earth removal member.

FIGS. 7A-B illustrate another embodiment of an earth removal member. FIG. 7A is a cross-sectional view of the earth removal member, and FIG. 7B is an end view of the earth removal member. As shown, the earth removal member 80 includes a nose 10 connected to a body 5. The body 5 includes stabilizers 25 having an insert 28 attached thereto, and a port 57 initially blocked using a shearable member. A plurality of nozzles 30 are disposed in the nose 16 and may be arranged in any suitable manner. A plurality of blade supports 14 extends from the face 16 and configured to receive a blade 15. The blade support 14 and the blade 15 may have mating profiles 31, 43 to facilitate engagement of the blade 15 to the blade support 14.

Figure 8:
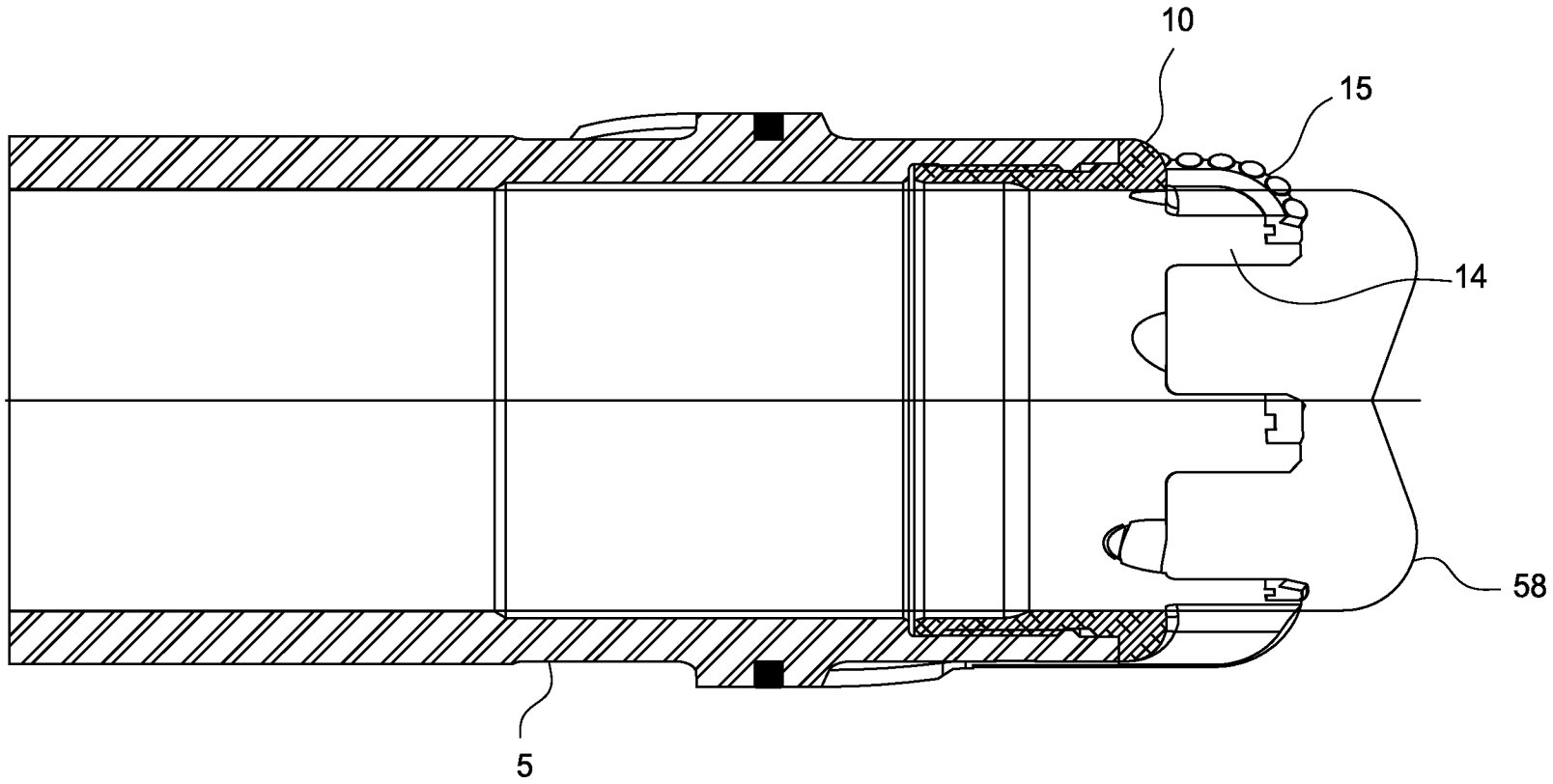

FIG. 8 shows the casing bit 1 of FIG. 1 after it has been drilled out by a subsequent drill bit. The subsequent drill bit may be another casing bit. The drill out path 58 of the subsequent drill bit is shown just beyond the drilled out casing bit 1. It can be seen that the remainder of the casing bit 1 includes an inner diameter that is substantially equal to the bore of the body 5. Also, during drill-out of the nose 10, the nose 10 is axially fixed relative to the body 5 due to the threaded connection between the nose 10 and the body 5. Further, the blade bonding process allows the blades 15 to remain attached to the blade support 14. In this respect, the blades 15 remains substantially intact until they are broken into smaller pieces by the subsequent drill bit. In can be seen that portions of the blades 15 outside of the drill out path 58 may remain attached to the body 5 or the nose 10. In one embodiment, the mass removed from the casing bit 1 may include more than 75% by weight of aluminum; preferably, more than 90% by weight of aluminum; and more preferably, more than 95% by weight of aluminum. The steel from the blade makes up a majority of the steel removed, which may be less than 15% by weight of the total mass removed; preferably, less than 5% by weight.

Figure 9A:
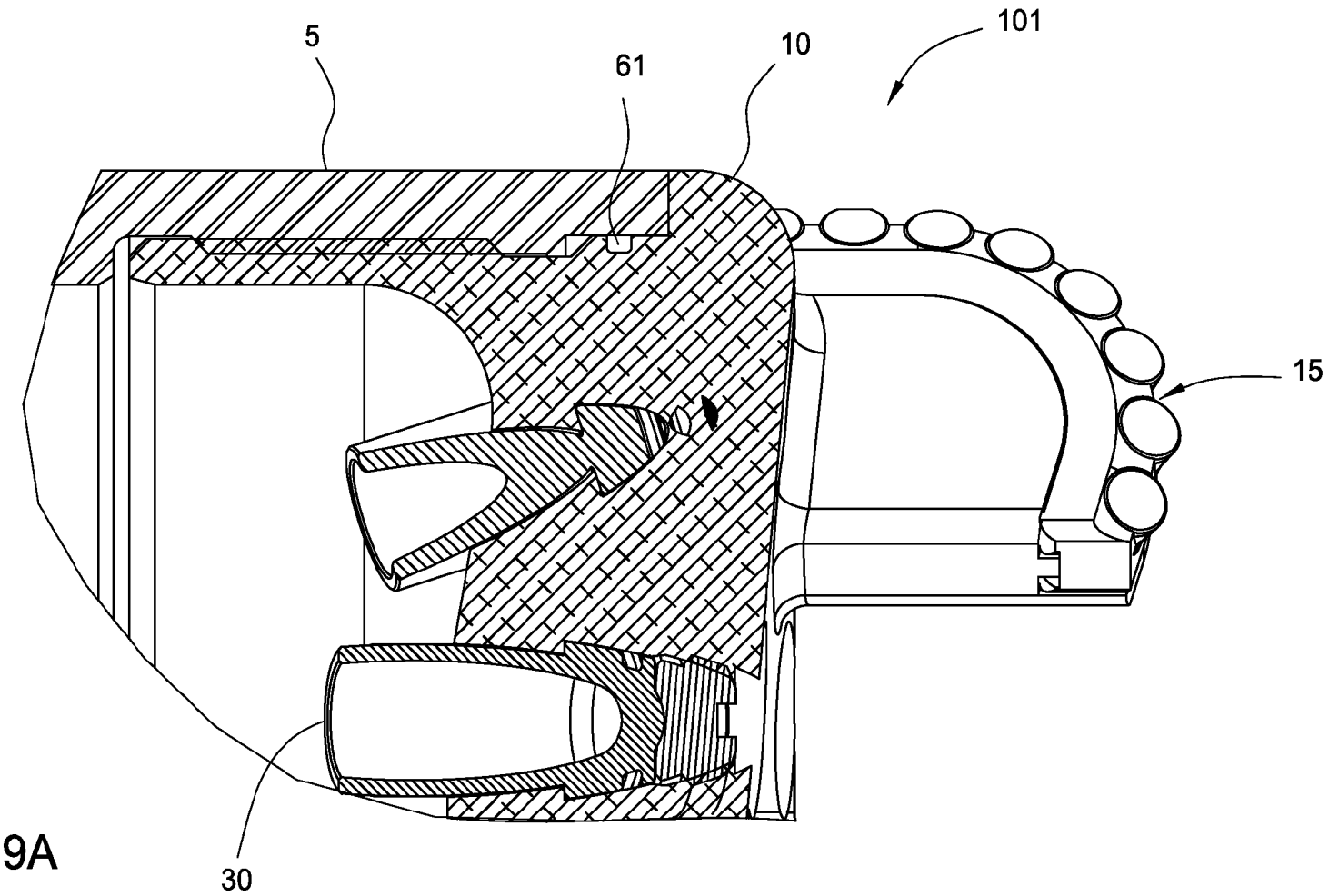
FIG. 9A shows a partial cross-sectional view of another embodiment of an earth removal member.
Figure 9C:
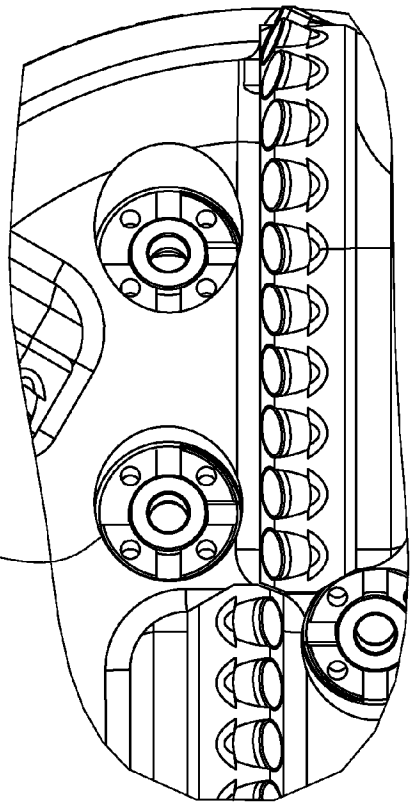
FIG. 9C is a partial end view of the earth removal member of FIG. 9B.

FIG. 9A shows a partial cross-sectional view of another embodiment of a casing bit 101. In this embodiment, an optional seal 61 is provided between the nose 10 and the body 5 to prevent a fluid leak path to the exterior of the casing bit 101. The nose 10 may include a plurality of nozzles 30 disposed in a plurality of fluid channels in the nose 10. A portion of the nozzle 30 may protrude out of the nose 10 and extend into an interior space of the casing bit 101. In another embodiment, the fluid channels could also be port holes for directing fluid. In yet another embodiment, the casing bit may have a combination of port holes and nozzles.

Figure 9B:
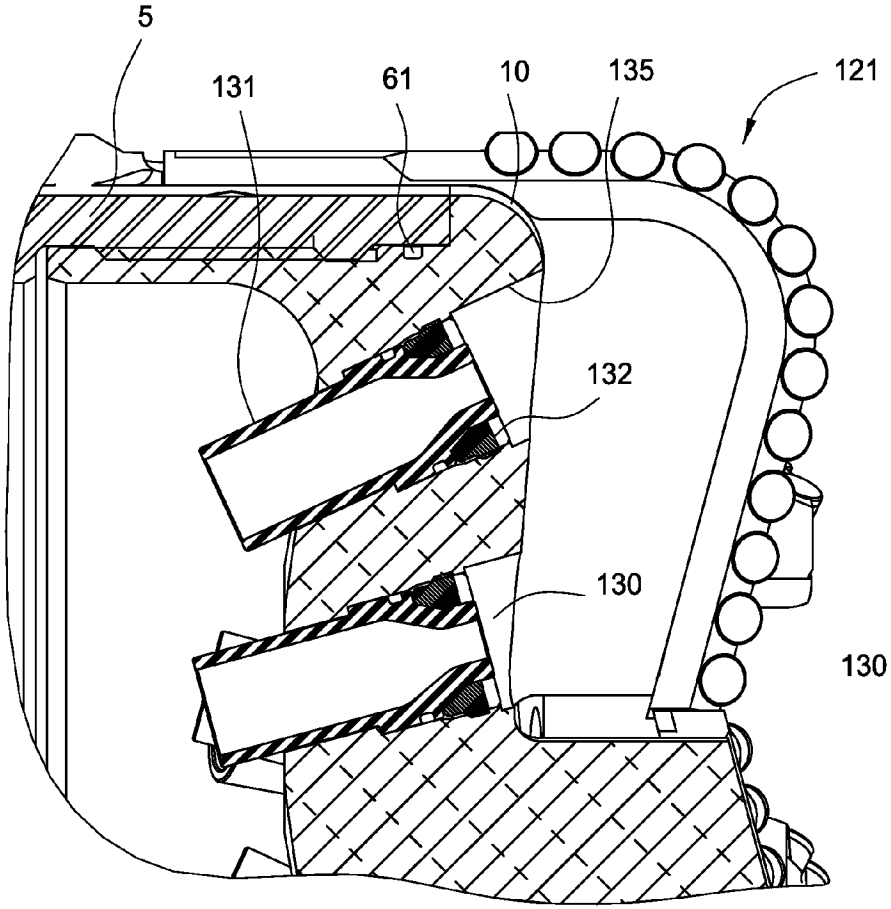
FIG. 9B shows another partial cross-sectional view of another embodiment of an earth removal member.

FIG. 9B shows a partial cross-sectional view of another embodiment of a casing bit 121. An optional seal 61 is provided between the nose 10 and the body 5 to prevent a fluid leak path to the exterior of the casing bit 121. The nose 10 may include a plurality of nozzles 130 disposed in a plurality of fluid channels 135 in the nose 10. Each nozzle 130 may include a flow tube 131 disposed in the fluid channel 135 and a retainer 132 for retaining the flow tube in the fluid channel. The retainer 132 may be threadedly connected to the channel 135 to retain nozzle 130 in the channel 135. In this respect, the nozzle 130 is mechanically retained in the fluid channel 135. A portion of the flow tube 131 may protrude out of the nose 10 and extend into an interior space of the casing bit 121. In one embodiment, the bore inside flow tube may have a smaller inner diameter near the exit, as shown, a constant inner diameter, or a larger inner diameter near the exit. In another embodiment, the flow tube may have an outer shoulder for engaging a shoulder to the fluid channel 135. In another embodiment, the fluid channels could also be port holes for directing fluid. In yet another embodiment, the casing bit may have a combination of port holes and nozzles.

Figure 10:
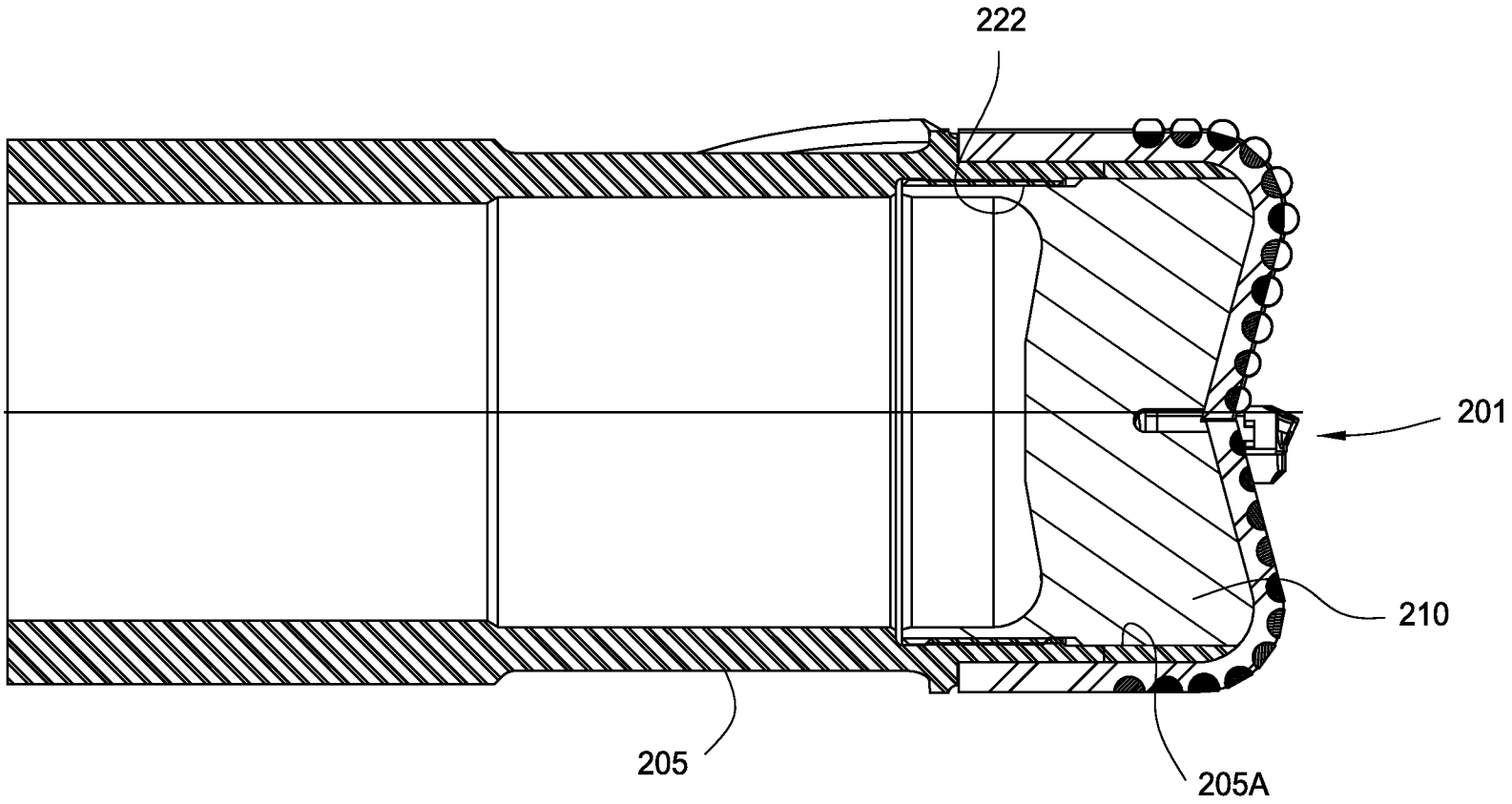
FIGS. 10 and 10A show another embodiment of an earth removal member.
Figure 10A:
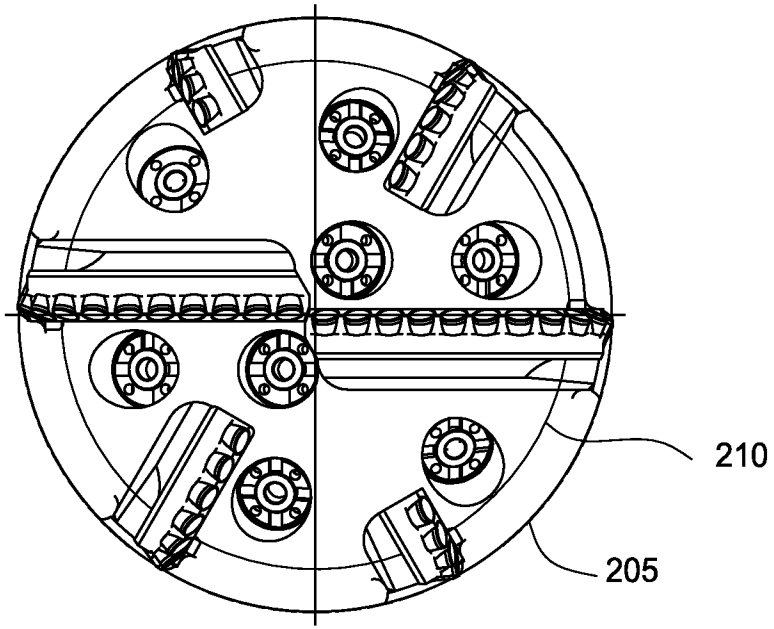

In another embodiment, the nose 210 of the casing bit 201 may have an outer diameter that is sized to fit within the body 205, as shown in FIG. 10. The front end 205A of the body 205 may extend beyond the threads 222 and surround the perimeter of the nose 210. The steel body 205, 205A surrounding the nose 210 provides added strength to the casing bit 201. However, the front end 205A has an inner diameter larger than the outer diameter of the subsequent drill-out bit so that it would not interfere with the drill out operation. Because the outer diameter of the nose 210 is still larger than the size of the subsequent drill bit, the nose 210 is still suitable for drill through. FIG. 10A is a bottom view of the nose 210 surrounded by the body 205. The body 205 may be made from any suitable material that provides suitable mechanical properties to substantially complement those of the casing to liner to which the body is attached, for example, steel. The nose 210 may be made from any suitable drillable material which has sufficient structural strength to support the loads applied to the blades during use of the earth removal member, but also which has properties suitable for subsequent removal by a standard drill bit.

Figure 11:
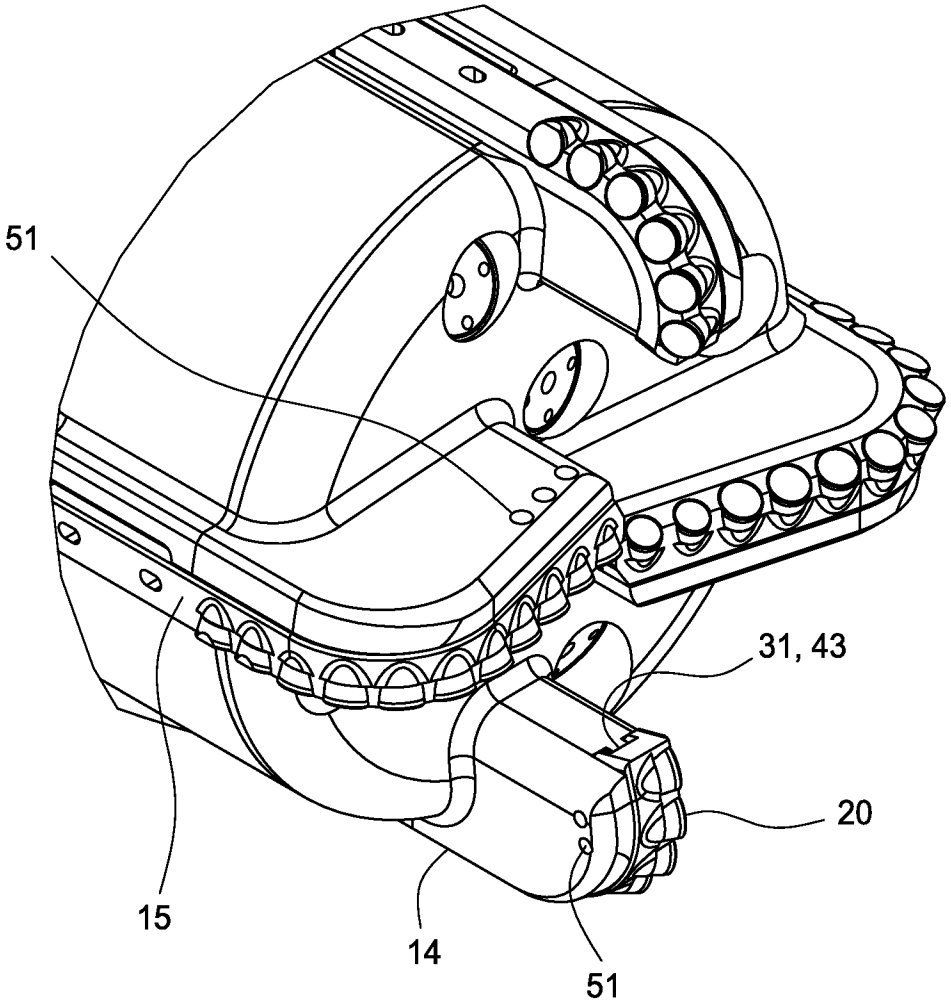
FIG. 11 shows an exemplary earth removal member having secondary locking members to retain the blades.

As shown in FIG. 11, the blades 15 may be locked to the blade support 14 using one or more secondary locking members such as pins, screws, or nails. The locking pins 51 may be used in addition to a bonding process such as welding. The pins 51 may be inserted through the blade support 14 and the blade 15. As shown, the pins 51 are disposed through the side wall of the blade support 14 and the blade 15. The pins 51 prevent the blades 15 from being separated from the nose 10 during drill out. The mating profiles 31, 43 between the blades 15 and the blade support 14 prevent the blades 15 from separating from the nose 10 during backward rotation of the blades 15. In this respect, the mating profiles and the locking members allow the casing bit to rotate in either direction. The pins may be made of a drillable material such as aluminum.

Figure 12:
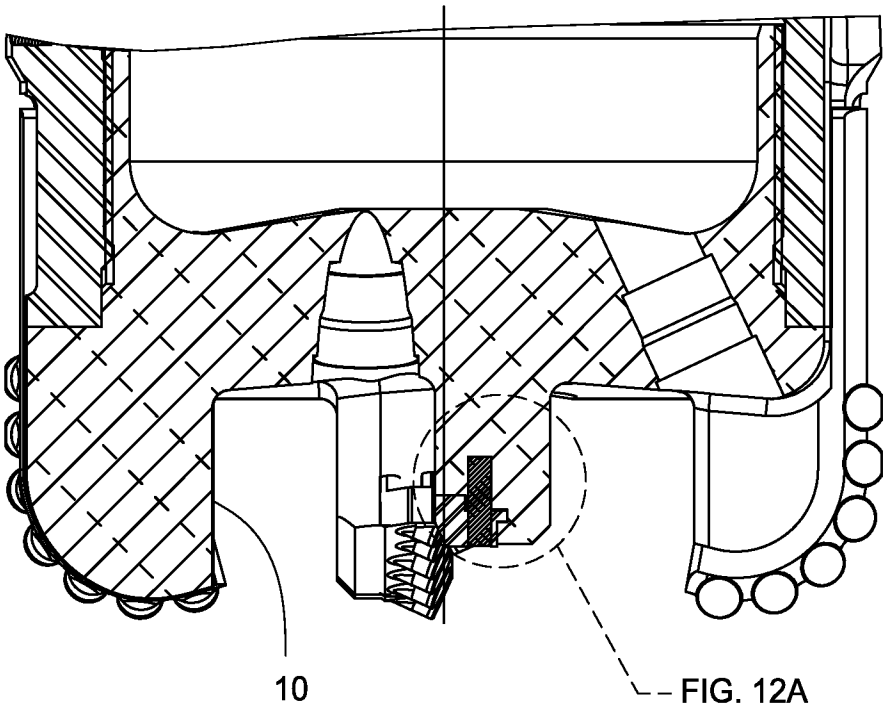
FIG. 12 shows another embodiment of locking the blades to an earth removal member.
Figure 12A:
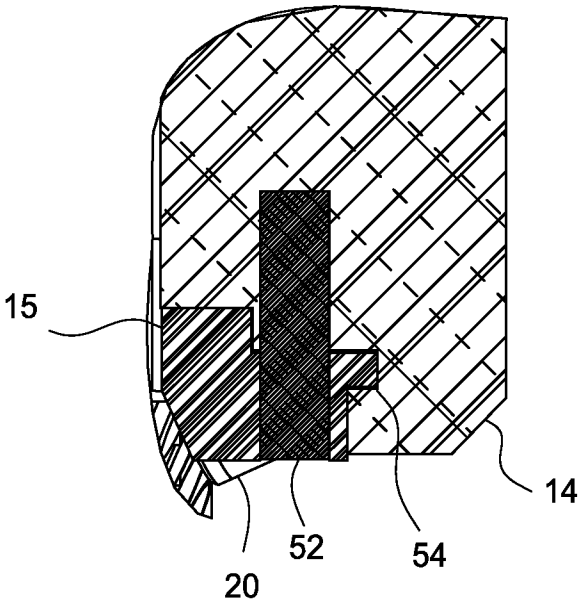
FIG. 12A is an enlarged partial view of FIG. 12.

Alternatively, as shown in FIG. 12, the pins 52 may be inserted through the blades 15 and then into the floor surface of the blade support 14. FIG. 12A is an enlarged partial view of FIG. 12. As shown, the mating profiles 54 are formed between the blade 15 and the side wall of the blade support 14. In this embodiment, the pins 52 serve to prevent displacement of the blade 15 during backward rotation of the blades 15, while the profiles 54 prevent the blade 15 from separating from the blade support 14 during drill out. It is contemplated that a combination of pins and mating profiles may be used to prevent the blades 15 from separating during operation. For example, pins 51, 52 may be separately inserted through the sidewall and the blades, and optionally, a mating groove profiles may be used. In this respect, the mating profiles and the locking members allow the casing bit to rotate in either direction. In yet another embodiment, the blades may be attached to the blade support using only the secondary locking members. The mating profiles and the secondary locking members allow coupling of the blade to the blade support without permanently fixing the blade to the blade support. However, it is contemplated that the blade may optionally be fixed such as by welding to the blade support.

Figure 13:
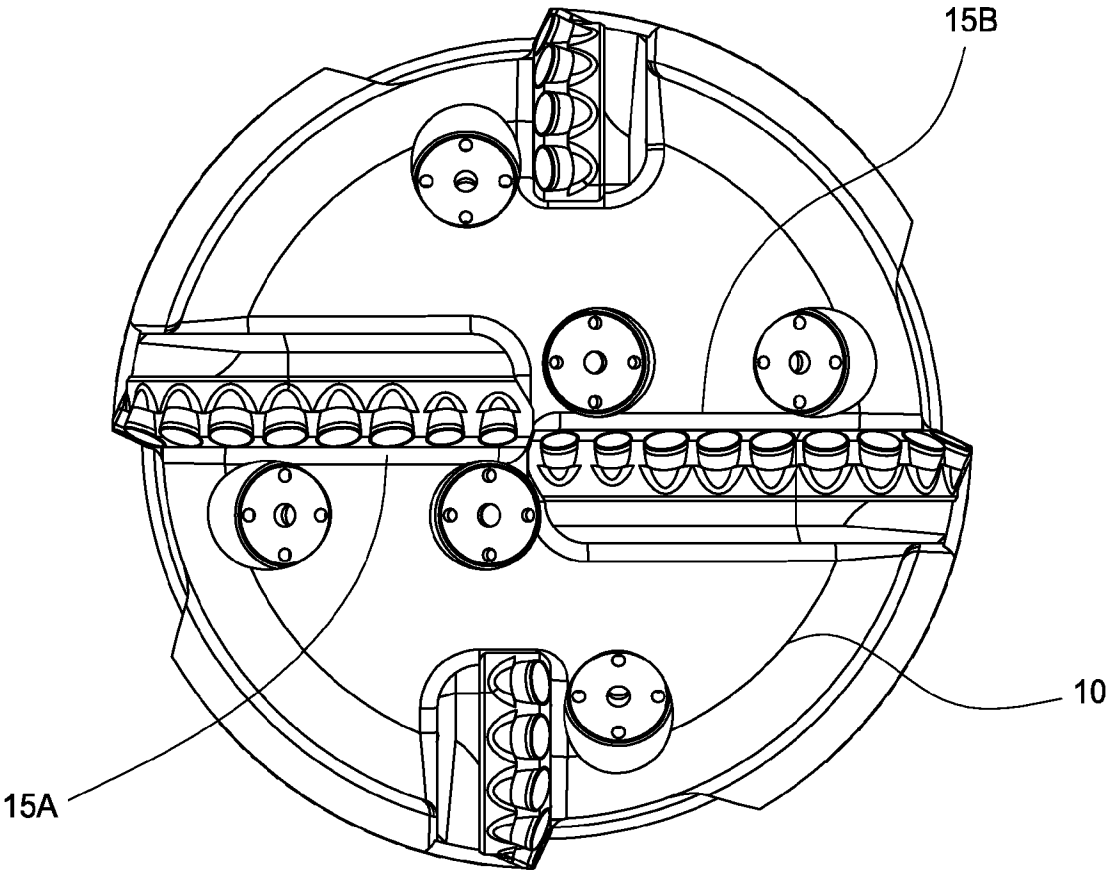
FIG. 13 shows an embodiment an earth removal member having two blades connected together.

In another embodiment, two or more blades 15A, B on the nose 10 may be connected to each other to provide additional support against separation during operation, as shown in FIG. 13. For example, the ends of two blades 15A, B near the center of the nose 10 may be welded together. Alternatively, the blades may be connected using an interlocking connection such as mating grooves, pins, dove tails, or other suitable mechanical locking devices or bonding methods. One or more of these locking or bonding devices or methods assist with maintaining the blades 15 in position during drill out. In this respect, the blades 15 are prevented from premature separation or breaking until it is broken into smaller pieces by direct contact with the drill-out bit.

While the foregoing is directed to embodiments of the present invention, other and further embodiments of the invention may be devised without departing from the basic scope thereof, and the scope thereof is determined by the claims that follow.

We claim:

1. An earth removal member for drilling a wellbore with casing or liner, comprising:

a tubular body;

a nose attached to one end of the tubular body, wherein the nose includes a blade support and comprises a drillable material, wherein the blade support is a raised portion on a face of the nose;

a blade attached to the blade support using mating profiles;

a locking member disposed in the blade support and the blade;

cutters disposed along the blade; and a nozzle disposed in the nose.

2. The earth removal member of claim 1, wherein at least 50% of the nose comprises aluminum.

3. The earth removal member of claim 1, wherein the blade comprises low yield steel or cast iron.

4. The earth removal member of claim 1, wherein the locking member is inserted through the blade.

5. The earth removal member of claim 1, wherein the locking member is inserted through the blade support.

6. The earth removal member of claim 5, wherein the mating profiles include a recess formed on the blade and a protrusion formed on the blade support.

7. The earth removal member of claim 5, wherein the mating profiles include a recess formed on the blade support and a protrusion formed on the blade.

8. The earth removal member of claim 1, wherein at least the face portion of the nose has an aluminum cross-section.

9. The earth removal member of claim 8, wherein the blade support comprises aluminum.

10. The earth removal member of claim 1, wherein at least a portion of the nose is disposed within the tubular body.

11. The earth removal member of claim 1, wherein the mating profiles include a recess formed on the blade support and a protrusion formed on the blade.

12. The earth removal member of claim 11, wherein the mating profiles prevent the blade from separating from the blade support during drill out.

13. The earth removal member of claim 1, wherein the mating profiles include a recess formed on the blade and a protrusion formed on the blade support.

14. The earth removal member of claim 13, wherein the mating profiles prevent the blade from separating from the blade during backward rotation of the blades.

15. The earth removal member of claim 1, wherein two blades are connected to each other.

16. The earth removal member of claim 1, wherein the nozzle is retained in the nose using a mechanical device.

17. The earth removal member of claim 1, wherein the blade is bonded to the blade support by welding, brazing, soldiering or an adhesive.

18. The earth removal member of claim 1, wherein the drillable material comprises one of an alloy of aluminum, a composite such as a cermet and glass/epoxy, and a plastic material.

19. The earth removal member of claim 1, wherein the mating profile includes a floor surface having a protrusion or a recess, and a side wall surface.

20. A method of removing an earth removal member, comprising:

providing the earth removal member with:

a tubular body;

a nose attached to one end of the tubular body, wherein the nose includes a blade support and comprises a drillable material;

a blade attached to the nose using mating profiles; and cutters disposed along the blade;

positioning a drill bit in the tubular body;

rotating the drill bit against an interior surface of the nose;

removing a portion of the nose while the blade is substantially attached to the nose; and rotating the drill bit against the blade, thereby breaking the blade into smaller pieces.

21. The method of claim 20, wherein the nose remains axially fixed to the tubular body during drill out.

22. An earth removal member for drilling a wellbore with casing or liner, comprising:

a tubular body;

a nose attached to one end of the tubular body, wherein the nose includes a blade support and comprises a drillable material, wherein the blade support is a raised portion on a face of the nose;

a blade attached to the blade support using mating profiles;

cutters disposed along the blade; and a nozzle disposed in the nose, wherein the blade is attached to the blade support using a bonding process or using a locking member disposed in the blade support and the blade so that the blade remains attached to the blade support during drill out.

23. The earth removal member of claim 22, wherein the blade is attached to the blade support using a locking member inserted through the blade and the blade support, and the locking member is selected from the group consisting of a pin, a screw, and a nail.

24. The earth removal member of claim 23, wherein the locking member is made of a drillable material.

25. The earth removal member of claim 22, wherein the blade is bonded to the blade support by welding, brazing, soldiering or an adhesive.

26. A method of removing an earth removal member, comprising:

positioning a drill bit in the earth removal member, wherein the earth removal member comprises:

a tubular body, wherein the drill bit is positioned in the tubular body;

a nose comprising a drillable material attached to one end of the tubular body, wherein the nose includes a blade support;

a blade attached to the blade support of the nose using mating profiles; and cutters disposed along the blade;

removing a portion of the nose while the blade is substantially attached to the nose by rotating the drill bit against an interior surface of the nose; and breaking the blade into pieces by rotating the drill bit against the blade.

27. An earth removal member for drilling a wellbore with casing or liner, comprising:

a tubular body;

a nose attached to one end of the tubular body, wherein the nose includes a blade support and comprises a drillable material, wherein the blade support is a raised portion on a face of the nose;

a blade attached to the blade support using mating profiles;

cutters disposed along the blade; and a nozzle disposed in the nose, wherein two blades are connected to each other.

* * * * *